US006358592B2

(12) United States Patent
Vair, Jr. et al.

(10) Patent No.: US 6,358,592 B2
(45) Date of Patent: Mar. 19, 2002

(54) MELTBLOWN FIBROUS ACOUSTIC INSULATION

(75) Inventors: Larry Leroy Vair, Jr., Lakewood, CO (US); Kenneth Andrew Clocksin, Grand Rapids, OH (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/777,913

(22) Filed: Feb. 6, 2001

Related U.S. Application Data

(62) Division of application No. 09/220,730, filed on Dec. 24, 1998, now Pat. No. 6,217,691.

(51) Int. Cl.[7] ..... E04B 1/82

(52) U.S. Cl. ..... 428/74; 428/76; 428/131; 428/137; 442/350; 442/351; 442/409

(58) Field of Search ..... 156/62.2, 167, 156/290, 219, 308.4, 209, 252, 176, 180, 181, 270; 264/112, 126; 428/74, 76, 131, 137; 442/350–351, 409

(56) References Cited

U.S. PATENT DOCUMENTS 3,855,045 A * 12/1974 Brock ..... 161/146
5,407,739 A * 4/1995 McCullough et al. ..... 428/287
5,545,279 A * 8/1996 Hall et al. ..... 156/201
5,554,238 A * 9/1996 English ..... 156/62.2
5,848,509 A * 12/1998 Knapp et al. ..... 52/406.2

* cited by examiner

*Primary Examiner*—Sam Chuan Yao
(74) *Attorney, Agent, or Firm*—Robert D. Touslee

(57) ABSTRACT

A fibrous insulation media is formed from a non-woven mat of thermoplastic fibers having a mean diameter of less than about 15 microns. Preferably, when used as an acoustical insulation, the media is formed of fibers having a mean diameter of less than about 13 microns; the media has a density of less than about 60 Kg/m$^3$; and the media has a Fraiser air permeability of less than 75 cubic feet per minute per square foot of surface area. The media has first and second major surfaces and a fibrous core with at least one of the major surfaces having an integral skin thereon. The skin is formed by melting fibers at and immediately adjacent the major surface of the mat formed into the media to form a thermoplastic melt layer which is subsequently solidified into a skin on the major surface of the mat. The thermoplastic fibers of the mat are point bonded together at spaced apart locations to increase the integrity of the mat.

13 Claims, 2 Drawing Sheets

MELTBLOWN FIBROUS ACOUSTIC INSULATION

This application is a division of application Ser. No. 09/220,730, filed Dec. 24, 1998 now U.S. Pat No. 6,217,691.

BACKGROUND OF THE INVENTION

The present invention relates to a meltblown fibrous insulation media of thermoplastic fibers and, in particular, to a meltblown fibrous insulation media of thermoplastic fibers which is especially suited for use as an acoustical insulation and the method of making such an insulation.

Fibrous insulation media are used for many thermal and/or acoustical applications including but not limited to the acoustical insulations in appliances which reduce the sound emitted into the surrounding areas of a home, acoustical insulations used in office partitions and wall panels, and the acoustical insulations used in vehicles and aircraft which function to isolate the passenger compartment from unwanted sounds or sound levels occurring outside of the passenger compartment. Currently, there are several forms of fibrous acoustical insulation media used as acoustical insulations for such applications and especially, for vehicle passenger compartments. One form of acoustical insulation used in vehicles is cotton shoddy. While this form of acoustical insulation media is inexpensive, it does not perform particularly well when compared to other automotive insulations currently on the market. Other forms of acoustical insulation media used in vehicles include a fibrous mat with a separate cover layer (a scrim, non-woven fabric, film or foil) laminated to a major surface of the mat such as marketed by Minnesota Mining and Manufacturing Company under the trademark "THINSULATE" (also see U.S. Pat. No. 5,298,694) and such as manufactured and sold by Johns Manville International, Inc.

The process for producing the acoustical insulation media manufactured and sold by Johns Manville International, Inc., essentially includes three processes. In the first process, a thin but meltblown tightly bonded cover stock is formed having a basis weight of about 0.75 oz/yd$^2$ or another cover stock, such as but not limited to a spun bond cover stock is formed. In the second process an air-laid, non-woven mat or fibrous layer of loose lofty randomly oriented meltblown thermoplastic fibers, e.g. fibers having a mean diameter of about 13.5 microns, and of the required thickness is formed. In a third process a heated pin or calendar roll collates a layer of cover stock onto each major surface of the mat or fibrous layer and, through the heated pins of a pin or calendar roll, heat point bonds the layers of cover stock to the major surfaces of the mat. As discussed above, the resulting product is a fibrous acoustical insulation media with a fibrous core layer of loose lofty fibers encapsulated between two surface layers of cover stock that are heat point bonded to the fibrous core layer. The loose fibers within the media provide an effective surface area for good acoustical absorption of sound waves and the films provide airflow resistance barriers for additional acoustical absorption of sound waves. The heat point bonding of the layers of cover stock to the fibrous core layer provides the acoustical insulation media with added integrity and improves the "handle-ability" of the product. While fibrous acoustical insulation media, such as this media, provide acceptable sound absorption for many applications, there has remained a need for acoustical sound absorption media with equal or better sound absorption properties, that can be more economically produced.

SUMMARY OF THE INVENTION

The fibrous insulation media of the present invention and the method of making the fibrous insulation media of the present invention provide acoustical insulation media with equal or better sound absorption properties than the acoustical insulation media of Johns Manville International Inc. discussed above and media which can be more economically produced than the acoustical insulation media of Johns Manville International Inc. discussed above. While, the fibrous insulation media of the present invention is especially suited for use as an acoustical insulation, the fibrous insulation media also may be used for applications other than acoustical applications. When the fibrous insulation media of the present invention is used as an acoustical insulation media, the fibrous insulation media is formed from a non-woven mat of thermoplastic fibers having a mean diameter of less than about 13 microns. For acoustical applications, the media has a density of less than about 60 Kg/m$^3$; a Fraiser air permeability of less than 75 cubic feet per minute per square foot of media surface area; and first and second major surfaces and a fibrous core with at least one of the major surfaces having a thin integral skin thereon. The skin is formed by melting fibers at and immediately adjacent the major surface of the non-woven mat to form a thermoplastic melt layer which is subsequently solidified into an air permeable skin on the major surface of the mat. The thermoplastic fibers of the mat are point bonded together at spaced apart locations to increase the integrity of the mat and preferably, increase the thickness of the mat adjacent the point bonded locations.

Preferably, the method of forming the fibrous insulation media of the present invention is an on-line process which includes: air laying thermoplastic fibers having a mean fiber diameter of less than about 15 microns (less than 13 microns for acoustical media) to form a non-woven mat; melting the thermoplastic fibers at and immediately adjacent at least one of the major surfaces of the mat to form a thermoplastic melt layer on the major surface(s) of the mat; subsequently cooling the thermoplastic melt layer(s) to form a thin, integral thermoplastic skin on the major surface(s) of the mat; and point bonding the thermoplastic fibers of the mat together at spaced apart locations to increase the integrity of the mat and preferably, increase the loft of the mat adjacent the point bonds by displacement of some of the thermoplastic fibers from the locations of the point bonds.

The thermoplastic fibers at and immediately adjacent one or both of the major surfaces of the mat can be melted to form a thermoplastic melt layer on the major surface or surfaces of the mat by flame treating, infrared treating or corona treating the surface or surfaces of the mat. However, preferably, the thin, integral skin is formed on one major surface of the mat by passing the mat between a heated nip or calendar roll with a smooth surface and a backing roll or integral skins are formed on both major surfaces of the mat by passing the mat between two heated nip or calendar rolls with smooth surfaces. Preferably, the major surface of the mat on which a skin is being formed is pressed against the heated surface of a nip or calendar roll by compressing the mat between the heated nip or calendar roll and a match or backup roll or by compressing the mat between two heated nip or calendar rolls. It is believed that the compression of the mat brings more fibers into contact with the heated surface of the nip or calendar roll and increases the density of the mat at and adjacent the heated surface of the nip or calendar roll for better heat transfer from the nip or calendar roll into the thermoplastic fibers of the mat. The result is a better melting of the thermoplastic fibers at and immediately adjacent the major surface of the mat in contact with the heated surface of the nip or calendar roll to form a melt layer on the major surface of the mat that is subsequently cooled and solidified to form an air permeable skin. When a skin was formed on a major surface of a mat without compressing the mat between a heated nip or calendar roll and a match or backup roll or another heated nip or calendar roll, the quality of the skin formed, for acoustical applications, was considerably inferior to the skin formed by compressing the mat between a heated nip or calendar roll and a match or backup roll or another heated nip or calendar roll.

The compression of the mat between a heated nip or calendar roll and a match or backup roll or another heated nip or calendar roll, decreases the thickness of the mat. Accordingly, the thickness and resiliency of the non-woven mat being introduced into the skin forming station of the process line must be sufficient to accommodate the decrease in thickness caused by the skin forming operation without permanently decreasing the thickness and the sound absorption properties of the mat below acceptable levels. In a preferred embodiment of the invention, the mat is made more resilient by forming the mat with thermoplastic fibers formed from a polymeric material with a nucleating agent.

Preferably, the point bonds are formed using the heat generated solely from the pressure exerted on the fibers by the pins of an unheated pin or calendar roll assembly. While the point bonds can be formed using heated pins of a heated pin or calendar roll assembly, the heat from the heated pins of such an assembly causes the thermoplastic fibers contacted and adjacent the heated pins to shrink down to form a point bond. When using unheated pins to form the point bonds, at least some of the thermoplastic fibers present along the paths of pins through the mat are pushed away or displaced from the paths of the pins thickening the mat adjacent the point bonds and leaving only a thin layer of thermoplastic fibers to form the point bonds through the heat generated by the pressure applied by the pins to the remaining thin layer of thermoplastic fibers. Thus, rather than decreasing the thickness of the mat which would decrease the sound absorption properties of the mat, the use of unheated pins maintains or in effect increases the thickness of the mat while increasing the integrity of the mat through the point bonding of thermoplastic fibers within the mat.

DESCRIPTION OF THE PREFERRED EMBODIMENTS

Figure 2:
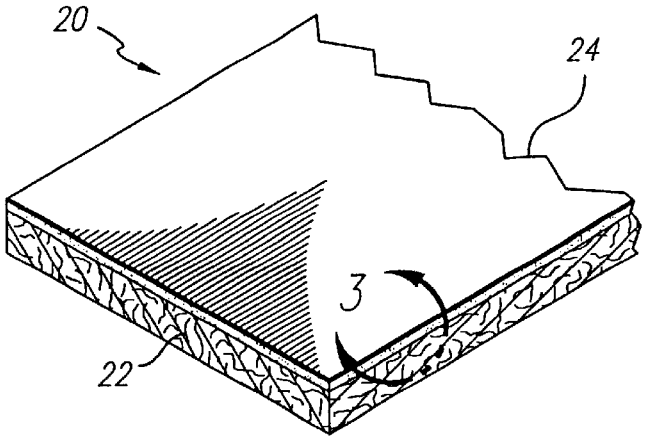
FIG. 2 is a schematic perspective view of a fibrous insulation medium of the present invention with a thin integral skin on one major surface.
Figure 1:
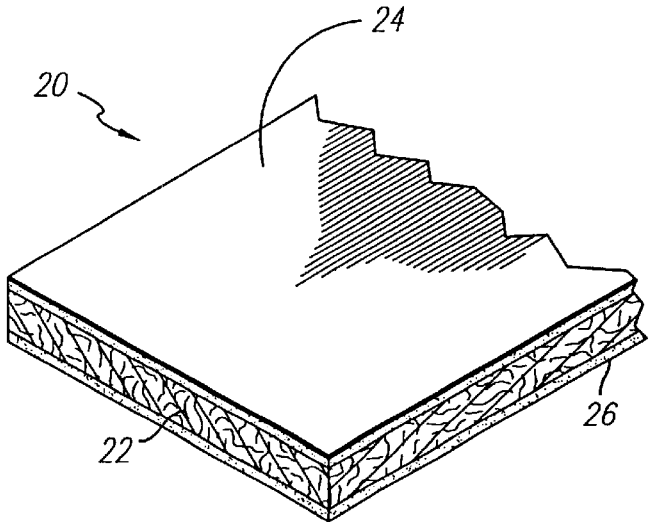
FIG. 1 is a schematic perspective view of a fibrous insulation medium of the present invention with a thin integral skin on both major surfaces.
Figure 3:
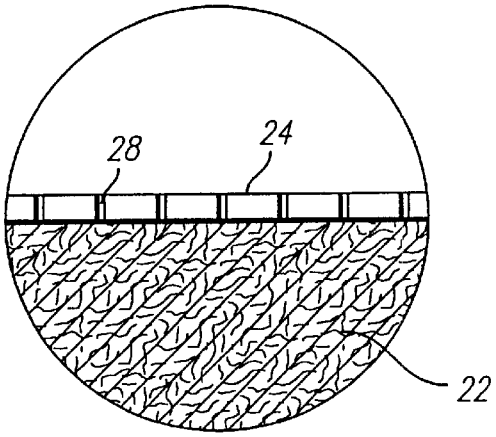
FIG. 3 is an enlarged schematic of the circled portion of the fibrous insulation medium of FIG. 2 to better illustrate the thin integral skin(s) formed on the major surface(s) of the fibrous insulation media of FIGS. 1 and 2.

As shown in FIGS. 1–3, the non-woven fibrous insulation media of the present invention 20 includes a fibrous layer 22 of randomly oriented, preferably air laid, thermoplastic fibers and two thin integral skins 24 and 26 formed on both major surfaces of the insulation media (FIG. 1) or a thin integral skin 24 formed on one major surface of the insulation media (FIG. 2). As schematically shown in FIG. 3, preferably, the thin, integral skin 24 or skins 24 and 26 are thin air permeable skins (the skins have a plurality of very fine holes or openings 28 therein and exhibit an air flow resistivity or Fraiser air permeability of less than about 75 cubic feet per minute per square foot of surface area, preferably less than about 50 cubic feet per minute per square foot of surface area, and most preferably less than about 30 cubic feet per minute per square foot of surface area) so that the skin(s) not only reflect sound waves but also provide of the fibrous insulation media 20 with one or two air flow resistance barriers that enhance the sound absorption properties of the fibrous insulation media by dampening the sound waves passing through the skin(s) when the media are used in acoustical applications. Typically, the fibrous insulation media 20 are between about 3 millimeters and about 20 millimeters in thickness and have basis weights ranging from about 5 to about 25 ounces per square yard (e.g. 5 millimeters and 7 ounces per square yard; 10 millimeters in thickness and 14 ounces per square yard; and 15 millimeters in thickness and 21 ounces per square yard).

The thermoplastic fibers forming the non-woven fibrous insulation media 20 have a mean fiber diameter, as measured by the surface analysis test commonly used in the industry (the BET test), between 0.5 microns and 15 microns and when used for acoustical applications, between 0.5 microns and 13 microns. The greater the surface area provided by the loose randomly oriented thermoplastic fibers in the fibrous insulation media 20, the better the sound absorption properties of the media 20. Thus, provided the media retains its loft, for a given basis weight, the finer the diameter of the thermoplastic fibers forming the fibrous insulation media 20 the better the sound absorption properties of the media and preferably, the thermoplastic fibers of the fibrous insulation media 20 have a mean diameter between about 2 microns and about 10 microns; more preferably between about 2 and about 5 microns; and most preferably between about 2 and about 3 microns.

When used for acoustical insulating applications, the fibrous insulation media 20 of the present invention has a density of less than about 60 kilograms per cubic meter ($Kg/m^3$) and preferably, less than about 50 Kg/m3. When used for acoustical insulating applications, the fibrous insulation media 20 of the present invention has an air flow resistivity or Fraiser air permeability number of less than about 75 cubic feet per minute per square foot of surface area, preferably less than about 50 cubic feet per minute per square foot of surface area, and most preferably less than about 30 cubic feet per minute per square foot of surface area.

Preferably, the fibrous insulation media 20 of the present invention is made from an air laid, non-woven mat 30 of meltblown randomly oriented thermoplastic fibers. While the fibers are randomly oriented, the fibers predominately lie generally in planes extending generally parallel to the major surfaces of the mat. Typically, the mat of meltblown thermoplastic fibers forming the fibrous insulation media is made by melting a polymeric material within a melter or die 32 and extruding the molten polymeric material through a plurality of orifices in the melter or die 32 to form continuous primary filaments. The continuous primary filaments exiting the orifices are introduced directly into a high velocity heated air stream which attenuates the filaments and forms discrete meltblown fibers from the continuous filaments. The meltblown fibers thus formed are cooled and collected on a moving air permeable conveyor 34 to form the non-woven mat 30 of randomly oriented polymeric fibers having a thickness greater than the thickness of the fibrous insulation media 20 to be formed from the mat 30, e.g. about 30% greater, and typically having a basis weight ranging from about 5 grams/sq. meter to about 500 grams/sq. meter. During this fiberization process, the molten polymeric material forming the fibers is rapidly cooled from a temperature ranging from about 450° F. to about 500° F. to the ambient temperature of the collection zone, e.g. about 80° F. The meltblown fibers formed by this process typically have a mean diameter from about 0.5 to about 15 microns.

Preferably, the polymeric material used to form the polymeric fibers of the fibrous insulation media of the present invention includes between about 0.2% and about 10% by weight of a nucleating agent and preferably, between about 1% and about 3% by weight of a nucleating agent to facilitate the formation of discrete fine diameter fibers which, when collected to form the mat 30, do not tend to meld together to form a less fibrous sheet-like material. The preferred polymeric material used to form the meltblown fibers of the fibrous insulation media of the present invention is polypropylene.

The presence of the nucleating agent in the polymeric material forming the fibers used in the fibrous insulation media of the present invention increases the rate of crystal initiation throughout the polymeric material thereby solidifying the fibers formed by the fiberization process of the present invention significantly faster than fibers formed from the polymeric material without the nucleating agent. The more rapid solidification of the polymeric material forming the fibers in the method of the present invention, due to the presence of the nucleating agent, reduces the tendency of the fibers to lose their discrete nature and meld together when collected and facilitates the retention of the fibers discrete nature when collected to form a resilient mat with high loft. In addition, the presence of the nucleating agent in the composition forming the fibers has been found to enhance the heat sealing properties of a polypropylene media.

The preferred nucleating agent used in the polymeric material of the present invention is bis-benzylidene sorbitol. An example of a suitable, commercially available, bis-benylidene sorbitol is MILLAD 3988 bis-benylidene sorbitol from Milliken & Company of Spartanburg, S.C. Although the particle size of the following nucleating agents may be too great, especially when forming very fine diameter fibers, it is contemplated that the following additives might also be used as nucleating agents: sodium succinate; sodium glutarate; sodium caproate; sodium 4-methylvalerate; sodium p-tert-butylbenzoate; aluminum di-p-tert-butylbenzoate; potassium p-tert-butylbenzoate; sodium p-tert-butylphenoxyacetate; aluminum phenylacetate; sodium cinnamate; aluminum benzoate; sodium B-benzoate; potassium benzoate; aluminum tertbutylbenzoate; anthracene; sodium hexanecarboxylate; sodium heptanecarboxylate; sodium 1,2-cyclohexanedicarboxylate; sodium diphenylacetate; sodium 2,4,5-tricholorphenoxyacetate; sodium cis-4-cyclohexane 1,2-dicarboxylate; sodium 2,4-dimethoxybenzoate; 2-napthoic acid; napthalene-1,8-dicarboxylic acid; 2-napthyloxyacetic acid; and 2-napthylacetic acid.

Figure 4:
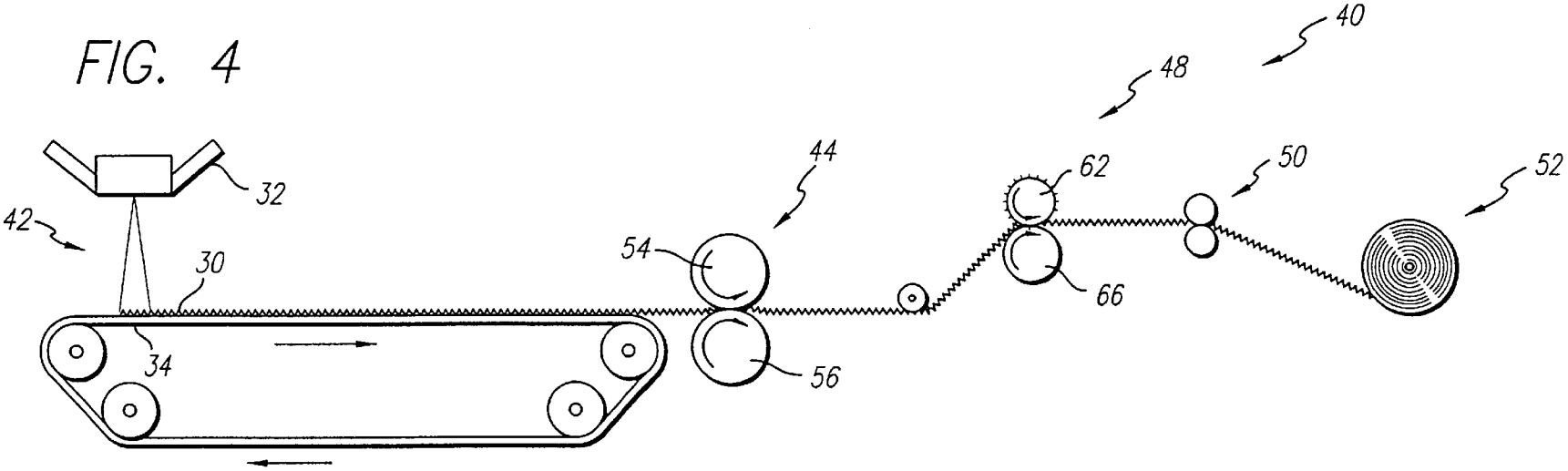
FIG. 4 is a schematic side elevation of a production line for making the fibrous insulation medium of FIG. 1.
Figure 5:
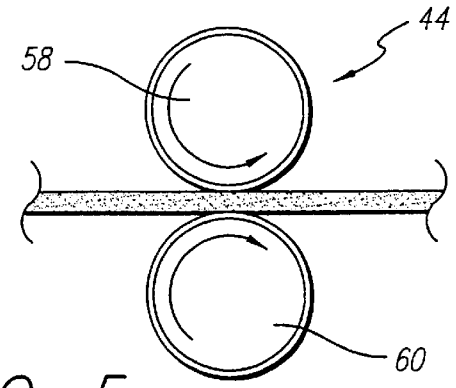
FIG. 5 is a schematic side elevation of a skin forming station required to make the fibrous insulation medium of FIG. 2.

As schematically shown in FIGS. 4 and 5, a preferred production line 40 for making the fibrous insulation media 20 of the present invention includes: a fiberization and collection station 42; a nip roll station 44; a point bonding station 48; a slitting station 50 and a windup station 52.

After the air laid non-woven mat 30 of meltblown thermoplastic fibers is collected in the fiberization and collection station 42, the mat 30 is conveyed to the nip roll station 44 where a skin is formed on both major surfaces or one major surface of the mat. In the nip roll station 44, when skins are to be formed on both major surfaces of the mat, the mat 30 is passed between upper and lower heated, smooth surfaced, cylindrical stainless steel nip rolls 54 and 56 (e.g. heated to a temperature ranging from about 150° F. and about 350° F. and preferably about 240° F.). As the upper major surface of the mat 30 is brought into contact with the heated cylindrical surface of the nip roll 54, the thermoplastic fibers at and immediately adjacent the upper major surface of the mat 30 are melted by the heat from the nip roll to form a thin melt layer on the upper major surface of the mat 30. As the lower major surface of the mat 30 is brought into contact with the heated cylindrical surface of the nip roll 56, the thermoplastic fibers at and immediately adjacent the lower major surface of the mat 30 are melted by the heat from the nip roll to form a thin melt layer on the lower major surface of the mat 30. When the upper and lower surfaces of the mat 30 move out of contact with the heated surfaces of nip roll 54 and 56, the thin melt layer on the upper and lower major surfaces of the mat 30 cool and solidify into skins 24 and 26, preferably air permeable skins, that are integral with the fibrous core of the mat 30.

While the heated nip rolls 54 and 56 may be spaced apart so that the mat 30 is subjected to little or no compression when passing between the heated nip rolls 54 and 56, the best results have been obtained by subjecting the mat 30 to compression as the mat passes between the heated nip roll 54 and 56 with the mat being compressed to between about 25% and about 50% of its final thickness. The compression of the mat 30 between the nip rolls 54 and 56 brings more of the mat's thermoplastic fibers into contact with the heated surfaces of the nip rolls 54 and 56 and increases the density of the mat 30 for better heat transfer to the fibers from the heated surfaces of the nip rolls 54 and 56. The result is the formation of more coextensive and uniform thin melt layers on the upper and lower major surfaces of the mat 30 that are subsequently cooled to form the thin skins 24 and 26 (preferably air permeable skins) on the upper and lower major surfaces of the mat 30 that are coextensive with the upper and lower major surfaces of the mat 30.

When a skin is to be formed on only one major surface, instead of two heated nip rolls, the nip roll station 44 is provided with an upper heated, smooth surfaced, cylindrical stainless steel nip roll 58 (e.g. heated to a temperature ranging from about 150° F. and about 350° F. and preferably about 240° F.) and a lower hard rubber match or backup roll 60, as shown in FIG. 5. As the upper major surface of the mat 30 is brought into contact with the heated cylindrical surface of the nip roll 58, the thermoplastic fibers at and immediately adjacent the upper major surface of the mat 30 are melted by the heat from the nip roll to form a thin melt layer on the upper major surface of the mat 30. When the upper major surface of the mat 30 moves out of contact with the heated surface of nip roll 58, the thin melt layer on the upper major surface of the mat 30 cools and solidifies into the skin 24, preferably an air permeable skin, that is integral with the fibrous core of the mat 30.

While the heated nip roll 58 and the match or backup roll 60 may be spaced apart so that the mat 30 is subjected to little or no compression when passing between the heated nip roll 58 and the match or backup roll 60, the best results have been obtained by subjecting the mat 30 to compression as the mat passes between the heated nip roll 58 and the match or backup roll 60 with the mat being compressed to between about 25% and about 50% of its final thickness. The compression of the mat 30 between the nip roll 58 and the match or backup roll 60 brings more of the mat's thermoplastic fibers into contact with the heated surface of the nip roll 58 and increases the density of the mat 30 for better heat transfer to the fibers from the heated surface of the nip roll 58. The result is formation of a more coextensive and uniform thin melt layer on the upper major surface of the mat 30 that is subsequently cooled to form the thin skin 24 (preferably an air permeable skin) on the upper major surface of the mat 30 that is coextensive with the upper major surface of the mat 30.

While it is preferred to use a nip roll station 44 to form one or two integral skins on the mat 30, the skin 24 or skins 24 and 26 can also be formed on the major surface or surfaces of the mat 30 by flame treating, infrared treating or corona treating the surface or surfaces of the mat.

After passing through the nip roll station 44 or a flame treating, infrared treating or corona treating station, the mat 30 with its skinned surface(s) passes through the point bonding station 48. The point bonding station 48 includes a cylindrical stainless steel calendar roll 62 with a plurality of metal pins 64 projecting radially outward from the cylindrical surface of the calendar roll and a smooth surfaced cylindrical stainless steel backup roll 66. The pins 64 typically have a diameter of about 3/16 of an inch and a length sufficient to penetrate the mat 30 and place the thermoplastic fibers of the mat 30 under compression to effect a point bonding of the fibers at spaced apart locations in the mat 30. Preferably, the pressure applied to the thermoplastic fibers by the pins 64 is sufficient to generate sufficient heat to thermally bond the fibers together without the need to heat the calendar roll and its pins, e.g. a compressive pressure between about 50 and about 150 pounds per square inch. As mentioned above, when the calendar roll 62 and its pins 64 are heated the thermoplastic material forming the fibers contacting and adjacent the pins tends to melt and shrink down. When the calendar roll 62 and its pins 64 are not heated, a large portion of the thermoplastic fibers of the mat in and immediately adjacent the paths of the pins are displaced from the bonding areas by the pins 64 as the pins pass through the mat 30 until only a thin layer of fibers remain to form the heat point bonds. The displaced and in many cases reoriented thermoplastic fibers (reoriented out of the planes of the major surfaces) effectively increase the loft and the thickness of the mat 30 adjacent the point bonds to improve the fibrous insulation media's acoustical sound absorption properties and provide the fibrous insulation media formed with a "quilted" appearance.

Figure 6:
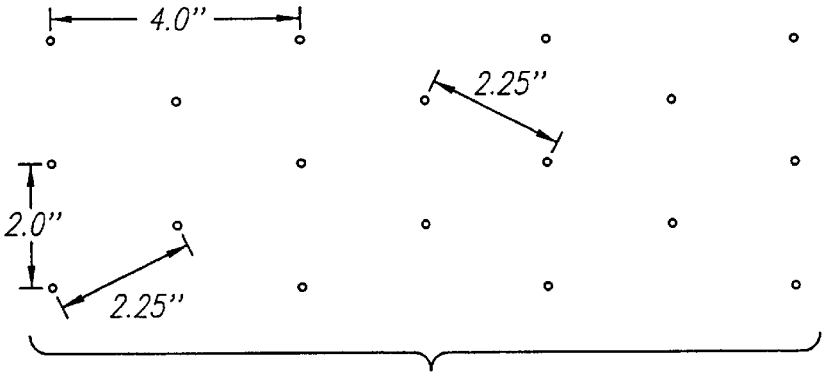
FIG. 6 is a schematic layout of a preferred pin pattern for the point bonding operation.

While other patterns can be used to locate the pins 64 and thus the point bonds in the mat 30, one preferred pin pattern is shown in FIG. 6. In this pattern, the pins 64 in each row are spaced from each other on about 4.0 inch centers; the rows are spaced from each other about 1.0 inch centers; and the pins in successive rows are off set from each other so that the pins 64 are spaced apart from each other on centers of about 2.25 inches. When the pins 64 are spaced apart from each other on less than about 1.0 inch centers, the point bonding operation tends to squeeze the insulation and reduce the mat's thickness. When the pins are spaced apart from each other on more than about 2.5 inch centers, no significant loft or added thickness to the mat 30 is created by the point bonding operation.

The Fraiser air permeability numbers for the media are determined by the Fraiser air permeability test which is a standard test commonly used in the industry for measuring air permeability. In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. An acoustical fibrous insulation media for attenuating sound waves passing through a first major surface of the media, comprising:

a non-woven mat of thermoplastic fibers, the thermoplastic fibers having a mean diameter of less than about 13 microns and being formed from a polymeric material containing between 0.2% and 10% by weight nucleating agent; the mat having a density of less than about 60 $Kg/m^3$; the mat having first and second major surfaces and a fibrous core; the first major surface having an integral skin thereon formed by melting fibers at and immediately adjacent the first major surface of the mat to form a thermoplastic melt layer which is subsequently solidified into the skin on the first major surface of the mat; the integral skin being an air permeable skin and airflow resistance barrier that attenuates sound waves; the mat having a Fraiser air permeability of less than 75 cubic feet per minute per square foot of surface area; and the thermoplastic fibers of the mat being point bonded together at spaced apart locations to increase the integrity of the mat.

2. The acoustical fibrous insulation media according to claim 1, wherein:

the thermoplastic fibers have a mean diameter between about 2 microns and about 10 microns.

3. The acoustical fibrous insulation media according to claim 1, wherein:

the thermoplastic fibers have a mean diameter between about 2 microns and about 10 microns and are formed from polypropylene containing between about 1% and about 3% by weight nucleating agent.

4. The acoustical fibrous insulation media according to claim 1, wherein:

the thermoplastic fibers have a mean diameter between about 2 microns and about 5 microns and are formed from polypropylene containing between about 1% and about 3% by weight bis-benzylidene sorbitol.

5. The acoustical fibrous insulation media according to claim 1, wherein:

the mat is an air laid mat between about 3 mm and about 20 mm in thickness and the mat is thickest adjacent the point bonds due to displacement of the thermoplastic fibers when the mat is point bonded.

6. The acoustical fibrous insulation media according to claim 1, wherein:

the second major surface of the mat has an integral skin thereon formed by melting fibers at and immediately adjacent the second major surface of the mat to form a thermoplastic melt layer which is subsequently solidified into the skin on the second major surface of the mat.

7. The acoustical fibrous insulation media according to claim 6, wherein:

the thermoplastic fibers have a mean diameter between about 2 microns and about 10 microns.

8. The acoustical fibrous insulation media according to claim 6, wherein:

the thermoplastic fibers have a mean diameter between about 2 microns and about 10 microns and are formed from polypropylene containing between about 1% and about 3% by weight nucleating agent.

9. The acoustical fibrous insulation media according to claim 6, wherein:

the thermoplastic fibers have a mean diameter between about 2 microns and about 5 microns and are formed from polypropylene containing between about 1% and about 3% by weight bis-benzylidene sorbitol.

10. The acoustical fibrous insulation media according to claim 6, wherein:

the mat is an air laid between about 3 mm and about 20 mm in thickness and the mat is thickest adjacent the point bonds due to displacement of the thermoplastic fibers when the mat is point bonded.

11. The acoustical fibrous insulation media according to claim 1, wherein:

the thermoplastic fibers have a mean diameter between about 2 microns and about 10 microns and are formed from polypropylene containing between about 1% and about 3% by weight nucleating agent; and the mat has a Fraiser air permeability of less than 50 cubic feet per minute per square foot of surface area.

12. The acoustical fibrous insulation media according to claim 1, wherein:

the thermoplastic fibers have a mean diameter between about 2 microns and about 5 microns and are formed from a polypropylene containing between about 1% and about 3% by weight bis-benzylidene sorbitol; and the mat has a Fraiser air permeability of less than 30 cubic feet per minute per square foot of surface area.

13. The acoustical fibrous insulation media according to claim 12, wherein:

the mat is an air laid mat between about 3 mm and about 20 mm in thickness and the mat is thickest adjacent the point bonds due to displacement of the thermoplastic fibers when the mat is point bonded.

* * * * *